United States Patent [19]

Grecsek

[11] Patent Number: 5,024,778

[45] Date of Patent: Jun. 18, 1991

[54] SPRAY DRIED BASE BEADS FOR DETERGENT COMPOSITIONS CONTAINING ZEOLITE, BENTONITE AND POLYPHOSPHATE

[75] Inventor: John J. Grecsek, Trenton, N.J.

[73] Assignee: Colgate-Palmolive Company, Piscataway, N.J.

[21] Appl. No.: 645,463

[22] Filed: Aug. 29, 1984

Related U.S. Application Data

[63] Continuation of Ser. No. 523,642, Aug. 15, 1983, abandoned, which is a continuation of Ser. No. 332,004, Dec. 18, 1982, abandoned, which is a continuation-in-part of Ser. No. 279,550, Jul. 1, 1981, abandoned, which is a continuation-in-part of Ser. No. 238,619, Feb. 26, 1981, abandoned.

[51] Int. Cl.[5] ..... C11D 7/16; C11D 3/06; C11D 3/14; C11D 17/00

[52] U.S. Cl. ..... 252/140; 252/8.6; 252/135; 252/174; 252/174.14; 252/174.21; 252/174.24; 252/174.25; 252/179; 252/540

[58] Field of Search ..... 252/8.6, 135, 140, 155, 252/174.14, 174.21, 174.24, 174.25, 179, 539, 540, 174

[56] References Cited

U.S. PATENT DOCUMENTS

| | | | |
|---|---|---|---|
| 3,838,072 | 9/1974 | Smith | 252/540 |
| 3,896,056 | 7/1975 | Benjamin et al. | 252/539 |
| 3,985,669 | 10/1976 | Krummel | 252/116 |
| 4,051,056 | 9/1977 | Hartman | 252/99 |
| 4,062,647 | 12/1977 | Storm et al. | 8/137 |
| 4,072,622 | 2/1978 | Kühling et al. | 252/179 |
| 4,166,039 | 8/1979 | Wise | 252/110 |
| 4,196,104 | 4/1980 | Oguagha | 252/542 |
| 4,203,851 | 5/1980 | Ramachandran | 252/8.6 |
| 4,215,004 | 7/1980 | Borgerding | 252/156 |
| 4,260,651 | 4/1981 | Wixon | 427/214 |
| 4,264,464 | 4/1981 | Gangwisch | 252/91 |
| 4,274,975 | 6/1981 | Corkill | 252/140 |
| 4,283,299 | 8/1981 | Becker et al. | 252/90 |
| 4,325,829 | 4/1982 | Duggleby | 252/109 |

OTHER PUBLICATIONS

*Surface Active Agents*, Schwartz & Perry, pp. 232, 233, 351 & 378, 1949.

*Primary Examiner*—Paul Lieberman

*Attorney, Agent, or Firm*—Bernard Lieberman; Murray M. Grill; Robert C. Sullivan

[57] ABSTRACT

Free flowing, zeolite-containing spray dried beads, useful for the manufacture of a particulate built synthetic nonionic organic detergent composition of reduced zeolite deposition characteristics due to the presence of bentonite and a low content of water soluble silicate or the absence of such silicate, include about 5 to 60% of water softening aluminosilicate (zeolite), about 2 to 40% of bentonite, about 5 to 60% of polyphosphate and up to about 5% of water soluble silicate. Preferably, for least zeolite deposition on the fabrics of laundry washed with the detergent composition, the spray dried beads contain no soluble silicate. Normally the moisture content of the beads will be in the range of about 3 to 12%, not being so high as to interfere with the flowability thereof (and of detergent compositions based on the beads) and not so low as to diminish the moisture content of the bentonite to a point at which it becomes less effective as an anti-deposition agent for the zeolite or zeolite-silicate aggregate and does not disperse readily in wash water. In addition to the polyphosphate, which serves as a very effective builder in these products, other water soluble builders may also be present. The invention also relates to nonionic detergent compositions based on such beads, which may be made by spraying such a nonionic detergent onto the beads so that it is absorbed by them.

2 Claims, No Drawings

SPRAY DRIED BASE BEADS FOR DETERGENT COMPOSITIONS CONTAINING ZEOLITE, BENTONITE AND POLYPHOSPHATE

This application is a continuation of Ser. No. 523,642, filed Aug. 15, 1983, which is a continuation of Ser. No. 332,004, filed Dec. 18, 1982, which is a continuation-in-part of my application Ser. No. 279,550, filed July 1, 1981, which is a continuation-in-part of my application Ser. No. 238,619, filed Feb. 26, 1981, all of which are now abandoned.

This invention relates to free flowing, spray dried base beads, which are useful for the manufacture of a particulate built synthetic nonionic organic detergent composition. It also relates to free flowing detergent compositions made from such base beads. More particularly, the invention relates to such beads and compositions which contain certain proportions (within prescribed ranges) of: a water softening aluminosilicate, such as a zeolite; bentonite; and a polyphosphate or mixture of polyphosphates, as water soluble builder(s) for detergents. The product made is of reduced zeolite deposition characteristics compared to prior art products containing similar proportions of the water softening aluminosilicate. Such prior art products have also contained appreciable proportions of water soluble silicate and normally have not have contained bentonite.

In recent years water softening insoluble aluminosilicates, such as hydrated zeolites, have been employed as builder constituents in laundry detergent compositions. Initially, renewed interest in the zeolites appears to have been stimulated by the necessity of producing detergent formulations which did not contain phosphates. Trisodium nitrilotriacetate and other salts of nitrilotriacetic acid (NTA), which had been suggested as potential replacements for the phosphates, especially for pentasodium tripolyphosphate, which had been used to a great extent in built laundry detergent compositions, had been suspected in some quarters of being harmful, and accordingly, for years compositions containing NTA were not marketed in the United States. Recently, disapproval by governmental authority of the use of NTA in detergents has been withdrawn and accordingly, such products are now marketable again. Phosphate-containing detergents have been recognized as superior in cleaning power to similar detergent formulations containing substitute builders, at least for certain types of soils on fabrics, and accordingly, have never been off the market except in a few locations where lake or stream eutrophication was considered to be a problem.

Although the zeolites, preferably zeolite A and especially preferably hydrated zeolite 4A, have been employed as builder salts in phosphate-free and NTA-free detergent compositions, they have now also been found to be useful components of improved base bead and detergent compositions containing polyphosphate(s). Normally about 6 to 12% of water soluble sodium silicate has been utilized in crutcher mixes from which spray dried base beads or built detergent compositions were to be made. The silicate has been employed for its binding effect on the other components of the bead, which binding results in stable beads, and it is believed that it helps to produce a reticulated inner bead structure. It also functions as an anti-corrosion additive which prevents chemical attack on aluminum parts of washing machines and other appliances with which detergent solutions may come into contact. However, in proportions formerly employed, e.g., 8 to 10% in the finished product, it had been noted that the combination of the water soluble silicate and the zeolite in the crutcher led to the production of aggregates of such materials in the spray dried beads, which aggregates objectionably deposited on washed materials, tending to adversely affect the appearances of colors thereof. By means of the present invention, utilizing certain proportions of zeolite, bentonite and polyphosphate, with little or no water soluble silicate, spray dried beads of sufficient mechanical stability to be commercially acceptable result and these are of reduced zeolite deposition characteristics (or reduced zeolite-silicate aggregate deposition characteristics). This reduction in deposits is especially noticeable when no soluble silicate is present but even when a small proportion of silicate is in the beads, it appears that the bentonite helps to counteract any tendency of the zeolite and silicate to react to produce a particle of larger size than that of the zeolite normally present, and thereby undesirable deposition of zeolite or zeolite-silicate particles on washed fabrics is prevented or lessened. Additionally, the compositions containing bentonite are much more readily disintegrated and distributed throughout the wash water, again apparently due to the presence of bentonite therein, which also helps to inhibit zeolite-silicate aggregation.

The polyphosphates are of good solubilities and together with the nonionic detergent added to the base beads to form a detergent composition, appear to aid dispersion of the product in the wash water. In the base beads they help to separate the zeolite from any soluble silicate or other material which may tend to cause aggregation or agglomeration of the zeolite or with the zeolite. Also, although the polyphosphates are hydratable and desirably should be in the form of their hydrates in spray dried base beads, they do not have an objectionably strong attraction for water, which otherwise could cause dehydration of the bentonite, and therefore they can be employed in base beads to complement the building effect of the aluminosilicate component. Another advantage of the invention, when little or no silicate is employed, is that formulations containing carbonate and/or bicarbonate as builders with the polyphosphate and zeolite do not require the presence of antigelling materials to prevent excessive thickening of the crutcher mix, or if such anti-gelling additives are considered to be desirable, lesser proportions thereof may be employed A review of the prior art indicates that among the more relevant references known to applicant are U.S. Pat. Nos. 4,062,647; 4,166,039; and 4,196,104; and British patent specifications 1,462,134; 1,556,437; and 1,570,128. The disclosures mentioned, which relate to detergent compositions and softening detergent compositions, include teachings that various detergent compositions can be made containing one or more of zeolite, bentonite, silicate, polyphosphate, quaternary ammonium compounds (softeners), and other components, usually with synthetic organic detergent, but although the disclosures contain extensive recitations (sometimes referred to as "laundry lists") of almost all materials which have been employed for any purpose in detergent and softening compositions, they do not include clear teachings or suggestions of the detergent compositions of the present invention, and this is especially true with respect to those containing little or no water soluble silicate. The disclosures do not appear to recognize the importance of the bentonite containing sufficient "lubricating" water between the plates thereof, and they do not appreciate the combination binding and disintegrating effects attributable to the "hydrated" bentonite. Also, many of the "reference" formulas contain appreciable proportions of sodium sulfate, a filler, possibly to improve the physical properties of the product particles, but such is not needed in the present compositions, which therefore can be of greater active ingredients (including polyphosphate and other builder) contents.

In accordance with the present invention free flowing, zeolite-containing spray dried beads, useful for the manufacture of a particulate built synthetic nonionic organic detergent composition, which composition is of reduced zeolite deposition characteristics due to the presence of bentonite therein and its low content of water soluble silicate or the absence of such silicate, comprise by weight from about 5 to 60% of water softening aluminosilicate, about 2 to 40% of bentonite, containing sufficient moisture to facilitate dispersion of the bentonite so as to inhibit deposition of zeolite on laundry being washed, about 5 to 60% of polyphosphate and 0 to about 5% of water soluble silicate. Preferably, for least zeolite or zeolite-silicate aggregate deposition on washed laundry the base beads will contain no water soluble silicate. In addition to the polyphosphate other water soluble builder salts may be present in supplementing proportions but preferably the prime water soluble builder component of the base beads is the polyphosphate or a mixture thereof, preferably as the sodium salt(s). Also within the invention are nonionic detergent compositions made from such base beads by spraying thereon of a nonionic detergent in liquid state, which is absorbed by the beads and, very preferably, solidifies in pores thereof.

Lengthy descriptions of the various components of the present beads and detergent compositions will not be given herein because such are set forth extensively in my parent application Ser. No. 279,550, and its parent application, Ser. No. 238,619 for at least the zeolite, bentonite, water soluble silicate and nonionic detergent. Accordingly, those specifications are hereby incorporated by reference for such descriptions and for other descriptions therein relevant to the subject matter of this application, e.g., polyacrylate, enzyme, colorants, other builders and other adjuvants. Thus, it is considered to be sufficient at this time to refer to the zeolites as crystalline, amorphous or mixed crystalline-amorphous zeolites which are normally at least partially hydrated and which have high exchange capacities for calcium ion, which capacity is normally from 200 to 400 or more milligram equivalents of calcium carbonate hardness per gram of the aluminosilicate, preferably 250 to 350 mg. eq./g. While other zeolites can also be employed, it is preferred that the zeolites used be sodium aluminosilicates containing about one molar proportion of sodium oxide, about one molar proportion of alumina and two or three molar proportions of silica, with up to nine molar proportions of water of hydration, preferably from about 2.5 to 6 such proportions. The hydrated form of the zeolite is preferably employed and the extent of hydration is normally about 15 to 70% of capacity, which is about 5 to 30% of water of hydration, preferably about 10 or 15 to 25%, such as 17 to 22%, e.g., 20%. The zeolite, if crystalline, will have a network of substantially uniformly sized pores in the range of about 3 to 10 Å often being about 4 Å. The zeolite ultimate particle diameters will usually be up to 20 microns, e.g., 0.005 or 0.01 to 20 microns, more preferably being 0.01 to 15 microns, e.g., 3 to 12 microns, and especially preferably being of 0.01 to 8 microns mean particle size, e.g., 3 to 7 microns, if crystalline, and 0.01 to 0.1 micron, e.g., 0.01 to 0.05 micron, if amorphous. Although ultimate particle sizes are much lower, usually the zeolite particles will be of sizes within the range of 100 to 400 mesh, preferably 140 to 325 mesh. Zeolites of smaller sizes will often become objectionably dusty and those of larger sizes may not sufficiently and satisfactorily attach to bentonite, phosphate and other builder base particles nuclei on which they may be distributed with the bentonite, such as in a gel-like or film state, during spray drying of a crutcher mix to form the base beads.

The bentonite utilized is preferably a Wyoming or western bentonite having a swelling capacity in the range of 3 to 15 ml./gram, preferably 7 to 15 ml./g., and its viscosity, at a 6% concentration in water, will usually be in the range of 3 to 30 centipoises, preferably 8 to 30 centipoises. Preferred swelling bentonites of this type are sold under the trademark Mineral Colloid, as industrial bentonites, by Benton Clay Company, an affiliate of Georgia Kaolin Co. Such materials were formerly marketed under the trademark THIXO-JEL by such company. They are selectively mined and beneficiated bentonites, and those considered to be most useful are available as Mineral Colloid 101, etc., and correspond to those formerly sold as THIXO-JELs No's. 1, 2, 3 and 4. These materials have pH's (6% concentration in water) in the range of 8 to 9.4 , maximum free moisture contents of about 8% and specific gravities of about 2.6, and for the pulverized grade about 85% passes through a 200 mesh U.S. Sieve Series sieve. Beneficiated Wyoming bentonite is preferred as a component of the present compositions but other bentonites are also useful, especially when they form only a minor proportion of the bentonite used. Although it is desirable to limit maximum free moisture content, as mentioned, it is more important to make certain that the bentonite being employed includes enough moisture, most of which is considered to be present between adjacent plates of the bentonite, to facilitate quick disintegration of the bentonite and any adjacent materials in the particles when such particles or detergent compositions containing them are brought into contact with water, such as when the detergent composition is added to the wash water. It has been found that at least about 2%, preferably at least 3%, more preferably, about 4% and most preferably 5% or more, to about 8% of water should be present in the bentonite initially, before it is admixed with the other bead components in the crutcher, and such a proportion of moisture should also be present after spray drying. In other words, overdrying to the point where the bentonite loses its "internal" moisture can significantly diminish the utility of the present compositions. When the bentonite moisture content is too low the bentonite does not act to the extent that is possible to prevent silicate-zeolite agglomerates being formed and it also does not aid enough in disintegrating the beads in the wash water. Also, when the bentonite is of satisfactory moisture content it exhibits an exchangeable calcium oxide percentage in the range of about 1 to 1.8 and with respect to magnesium oxide such percentage will normally then be in the range of 0.04 to 0.41, which exchange capacity is often desirable.

The phosphates utilized in making the base beads and detergent compositions of this invention are, for all practical purposes, polyphosphates. The alkali metal salts are preferred and of these the sodium salts are considered to be best, although sometimes potassium salts are effective, too. Primarily, the polyphosphates of greatest interest are the tripolyphosphates and pyrophosphates, e.g., pentasodium tripolyphosphate and tetrasodium pyrophosphate. Other water soluble builders may also be present, usually at a concentration less than that of the polyphosphate(s). Among those which are considered to be effective in conjunction with the polyphosphates in the present base beads and detergent compositions are: carbonates and bicarbonates, preferably as the sodium salts; borates, e.g., borax; citrates; gluconates; EDTA; and iminodiacetates. Preferably the various builders will be in the forms of their alkali metal salts, either the sodium or potassium salts, or a mixture thereof, but sodium salts are normally very much more preferred. In some instances, as when neutral or slightly acidic detergent compositions are being produced, acid forms of the builders, especially of the organic builders, may be preferable, but normally the salts will either be neutral or basic in nature.

The silicates, preferably sodium silicate of $Na_2O$:-$SiO_2$ ratio within the range of 1:1.6 to 1:3, preferably 1:2 to 1:2.8, e.g., 1:2.35 or 1:2.4, also serve as builder salts but because of their strong binding properties and their characteristic of promoting aggregation or agglomeration with zeolite particles, they are special cases of builders, and it is preferred that they be omitted from the present compositions. However, because they do possess anti-corrosion properties, especially important when the detergent solution is to be employed in washing machines or other appliances in contact with aluminum parts thereof, they may sometimes be present in limited small proportions. In such instances it will usually be preferable for hydrous sodium silicate particles to be post-added, so that they do not react with or agglomerate with zeolite particles in the crutching and spray drying operations. Although sodium sulfate and sodium chloride and other filler salts possess no building properties they are sometimes utilized in detergent compositions for their filling characteristics. In addition to increasing the volume and weight of the product to facilitate measuring, they also sometimes improve bead stabilities and physical properties of the detergent composition beads in which they are incorporated. Nevertheless, because the present compositions are satisfactory without any fillers being present, such are preferably avoided entirely or any proportion thereof present is minimized, usually to a practical minimum, leaving more "room" in the product formula for active and effective components.

Normally the spray dried base beads will have no nonionic detergent present therein, although up to 2 to 4% may sometimes be desirable in the crutcher. Usually the nonionic detergent or most of it is added to the base beads to form a detergent composition by post-spraying onto surfaces of the tumbling beads. Although various nonionic detergents of satisfactory physical characteristics may be utilized, including condensation products of ethylene oxide and propylene oxide with each other and with hydroxy-containing bases, such as nonyl phenol and Oxo-type alcohols, it is highly preferred that the nonionic detergent be a condensation product of ethylene oxide and higher fatty alcohol. In such products the higher fatty alcohol is of 10 to 20 carbon atoms, preferably 12 to 16 carbon atoms, and the nonionic detergent contains from about 3 to 20 or 30 ethylene oxide groups per mol, preferably from 6 to 12. More preferably, the nonionic detergent will be one in which the higher fatty alcohol is of about 12 to 13 or 15 carbon atoms and which contains from 6 to 7 or 11 mols of ethylene oxide. Such detergents are made by Shell Chemical Company and are available under the trade names Neodol® 23-6.5 and 25-7. Among their specially attractive properties, in addition to good detergency with respect to oily marks on goods to be washed, are comparatively low melting points, which still are appreciably above room temperature, so that they may be sprayed onto base beads as liquids which quickly solidify.

Various adjuvants may be present in the crutcher mix from which the base beads are spray dried, or such adjuvants may be post-added, with the decision as to the mode of addition often being determined by the physical properties of the adjuvant, its resistance to heat, its resistance to degradation in the aqueous crutcher medium, and its volatility. Among the more important of the adjuvants for the present products is a polyacrylate which has been found to be useful in controlling bead characteristics and bulk density, has dispersing, anti-deposition and anti-redeposition effects in the present compositions, and aids in maintaining the crutcher mix fluid and homogeneous.

The polyacrylate, present in preferred base beads of this invention, is a low molecular weight polyacrylate, such molecular weight usually being within the range of about 1,000 to 5,000, preferably 1,000 to 3,000, and most preferably 1,000 to 2,000 or about 2,000. The polyacrylate may be partially neutralized or completely neutralized, e.g., about ½ or ⅓ present as sodium polyacrylate. The polyacrylates help to bind calcium ion and prevent deposition of insoluble calcium compounds from aqueous solutions onto materials being washed with the present detergent compositions. In the spray drying process small proportions thereof help to maintain the homogeneity of the crutcher mix and help to make the resulting beads of improved porosity. Use of the polyacrylate also facilitates control of the density of the beads and of the detergent composition.

When the crutcher mix includes carbonate and/or bicarbonate and silicate, even if the amount of the silicate is small, there may be a tendency for the mix to gel or "freeze" in the crutcher, especially if, due to delays in processing, the crutcher mix is held longer than the normal 30 minutes or so. In such cases processing aids are preferably also present in the mix (and consequently are in the finished base beads and detergent composition), to prevent premature solidification or gelation in the crutcher. Most preferably, such anti-gelling additives include citric acid and magnesium sulfate. Instead of citric acid, soluble citrates, such as sodium citrate, may be used, and while it is preferable to employ anhydrous magnesium sulfate, various hydrates thereof, such as epsom salts, may also be used. Although such and other processing aids are useful in many cases, it is a feature of this invention that they are not needed in manufacturing the present preferred base beads from which silicate is omitted.

Although some adjuvants, such as fluorescent brightener, pigment, e.g., ultramarine blue, titanium dioxide, and inorganic filler salts, may be added in the crutcher, others, such as perfumes, enzymes, bleaches, some colorants, bactericides, fungicides, fabric softeners and flow promoting agents may often be sprayed onto or otherwise mixed with the base beads or spray dried detergent composition, with any nonionic detergent and/or independently, so that they will not be adversely affected by the elevated temperatures of the spray drying operation and also so that their presence in the spray dried beads does not inhibit absorption of nonionic detergent, when such is to be post-sprayed onto the beads. However, for stable and normally solid adjuvants, mixing with the starting slurry in the crutcher is also feasible. Thus, it is contemplated that pigments and fluorescent brighteners, when employed, will normally be present in the crutcher mix from which the present base beads are sprayed. The preferred coloring agent is ultramarine blue but other stable pigments and dyes may be used with it or in replacement of it. Because the spray dried base beads of this invention sometimes may be off-color, usually due to employment of naturally occurring minerals, the hue from such coloring agent may be adversely affected. It has been found that incorporating a small proportion of titanium dioxide in the crutcher mix may be desirable because it helps to retain the desired hue of the coloring agent and the presence of the titanium dioxide does not appear to have any adverse affect on the appearance of laundry washed with detergent compositions made from base beads containing it.

Among the fluorescent brighteners the most preferred is Tinopal 5BM, especially in extra concentrated form. Various other types of brighteners may also be employed and the brighteners may be charged as their corresponding acids, although their sodium salts are normally preferred. Generally, the types of brighteners known as cotton brighteners will usually comprise major proportions of any brightening system employed.

Enzyme preparations, which normally are post-added to the base beads, because they are heat sensitive, may be any of a variety of commercially available products, included among which are Alcalase, manufactured by Novo Industri, A/S, and Maxatase, both of which are alkaline proteases (subtilisin). Maxazyme 375 is sometimes preferred. Although the alkaline proteases are most frequently employed, amylolytic enzymes, such as alpha-amylase, may also be utilized. Perfumes employed, which are usually heat sensitive and may contain volatiles, including a solvent, such as alcohol, are normally of synthetic perfumery materials, sometimes mixed with natural components, and generally will include alcohols, aldehydes, terpenes, fixatives and other normal perfume components.

Flow promoting agents, such as special clays, which are sometimes added to detergent products, while often useful to improve flowability and to diminish tackiness of various compositions, are unnecessary in the present case, possibly in part due to the presences of the bentonite and polyphosphate and the absence or very limited presence of silicate. However, they may be added if desired, to further increase flowability. While it has been found that detergent compositions made from the present base beads do not require the presence of any anti-corrosion additive to replace the omitted silicate, it is within the invention to utilize suitable such materials and it will be preferred to employ those which are stable under crutching and spray drying conditions and which do not adversely affect such operations. If it is desired to continue to utilize a silicate for such purpose or to employ a silicate for its magnesium ion hardness treatment effect a powdered silicate will normally be preferable, such as hydrous sodium silicate, which is commercially available under the name Britesil® ($Na_2O:SiO_2$32 1:2.4), manufactured by Philadelphia Quartz Co., and such will preferably be post-added. However, other normally solid soluble silicates, preferably of alkali metals, may also be post-added to the beads of this invention, preferably after any absorption of nonionic detergent that is to be effected.

When it is desired for the product made to possess textile softening characteristics, softening materials, preferably in dry powder form, may also be post-added to the base beads in suitable manner. This class of materials is well known and most generally such softeners are cationic compounds, particularly quaternary ammonium compounds, such as quaternary ammonium halides. Preferred softeners include the higher alkyl-, alkylaryl- and arylalkyl-lower alkyl quaternary ammonium chlorides and bromides, such as distearyl dimethyl ammonium chloride. Of commercial softening materials that which is most preferred is sold under the trade name Arosurf TA-100, manufactured by Sherex Chemical Company, Inc. Such compounds possess anti-static and antibacterial properties too, but if desired, other antibacterial adjuvants may also be employed, preferably also incorporated in the product by post-addition.

Of course, water is present in the crutcher to serve as the medium for dispersing the various other bead components, and some water, in both free and hydrate form, is in the product. During drying of the beads the initial moisture content thereof, which will be about 25 to 60%, from the crutcher mix, may be lowered to about 5 to 15%, with such moisture content being sufficient so that the bentonite in the dried beads contains at least 2% and preferably at least 4% of moisture. It is preferred to employ deionized water, so that the hardness ion contents thereof may be very low and so that metallic ions that can promote decomposition of any organic materials which may be present in the crutcher mix, base beads and detergent are minimized, but city or tap water may be employed instead. Normally the hardness content of such water will be less than 150 p.p.m., as $CaCO_3$, more preferably the hardness content will be less than 100 p.p.m., and most preferably it will be less than 50 p.p.m.

The proportions of the various components in the base beads and in the spray dried detergent composition beads will be such as to result in their being free flowing and, for the base beads, sufficiently absorptive of a nonionic detergent applied thereto in liquid state so that the detergent compositions will be satisfactorily free-flowing. Also, of course, the detergent compositions will be effective cleaning agents, with the builders present acting to assist the organic detergent in its detersive effect in aqueous solutions of the compositions, and it is important that the resulting products be such that they do not cause objectionable depositions of zeolite particles (or zeolite-silicate aggregates) on washed materials. The zeolite particles and the bentonite particles, although insoluble, will not objectionably discolor or lighten colored laundry as charged, because of their small particle sizes, but such discoloration can occur when zeolite aggregates are formed which are sufficiently large so as to be held to fabrics and also to be readily noticeable to the eye, especially when substantial proportions thereof are not removed from the laundered materials by being exhausted with the drying air during atomatic drying. It is also desirable for the base beads and detergent composition beads made to be of appropriate bulk density and color.

It has been found that satisfactory beads to accomplish the aforementioned purposes comprise by weight from 5 to 60% of water softening aluminosilicate (zeolite), 2 to 40% of bentonite (of the desired moisture content), 5 to 60% of polyphosphate and 0 to about 5% of water soluble silicate. The spray dried beads may contain from 3 to 15% of moisture providing such moisture content does not make them poorly flowing. Normally the limits on the moisture content will be within the range of about 3 to 12%, preferably 5 to 10%. In computing such moisture content the water of hydration of the various builders and other materials present is included, as is the water present between the plates of bentonite. The bulk density of the product will normally be within the range of 0.2 to 0.8 g./cc. and the particle sizes will be in the No. 10 to 100 , U.S. Sieve Series range. For best results it is often desirable that the proportion of bentonite to zeolite be within the range of about 1:6 to 1:1, the proportion of polyphosphate to zeolite be within the range of about 1:3 to 3:1 and the proportion of bentonite to polyphosphate be within the range of about 1:10 to 1:1. More preferred ranges are 1:6 to 1:2, 1:2 to 2:1 and 1:6 to 1:2, respectively. Percentagewise, the base beads will normally comprise from 10 to 40% of hydrated sodium zeolite (and preferably the zeolite will be of 15 to 25% moisture content), 2 to 25% of bentonite (preferably of a swelling capacity in the 7 to 15 ml./g. range and of a viscosity at 6% concentration in water in the range of 8 to 30 cp.), 10 to 50% of polyphosphate (preferably as the sodium salt, e.g., pentasodium tripolyphosphate, tetrasodium pyrophosphate, or mixture thereof), and 5 to 10% of moisture, with any alkali metal silicate present (0 to about 5%) being a sodium silicate of $Na_2O:SiO_2$ ratio within the 1:2 to 1:2.8 range. Preferred proportions are: 15 to 35% of zeolite A, 5 to 20% of beneficiated Wyoming bentonite containing at least 4% of moisture, 15 to 40% of polyphosphate (such as STPP or TSPP), 0.05 to 1% of sodium polyacrylate and 0% of sodium silicate. When additional water soluble builder salt is present (other than polyphosphates) the proportion thereof will generally be within the range of 1 to 40%, preferably 5 to 30% and more preferably 10 to 25%, with mixtures of two or more builders sometimes being employed. Of the builders the carbonates or mixtures of carbonates and bicarbonates are often employed, although borax and the known organic builders, such as gluconates and citrates are also useful. If silicates are used in such preparations the $Na_2O:SiO_2$ ratio will normally be about 1:2.4.

To manufacture a detergent composition from the base beads is a relatively simple matter. Because of the good bead structure a substantial proportion of nonionic detergent is absorbable, while the product made is still flowable and is not objectionably lazy. Generally, from 5 to 30% of nonionic detergent is sprayed onto the tumbling base beads, with the detergent preferably being at a temperature high enough to melt it, although water solutions may also be utilized (but they require removal of more moisture in the spray drying process to keep the beads from losing flowability characteristics). Of course, the proportion of nonionic detergent used will be such as to maintain such flowability. Preferably such proportion will be from 10 to 25% and more preferably, about 20% of detergent will be employed, which proportion is such as to maintain good flowability and give the detergent composition good cleaning properties. Flowability of detergent compositions, especially those high in nonionic detergent content, may be improved by blending such a composition with another more readily flowable detergent product, such as one which comprises 5 to 30% of a synthetic anionic organic detergent, 30 to 90% of a builder for such detergent preferably including zeolite and polyphosphate builders, 2 to 20% of adjuvant(s) and 3 to 15% of moisture. Of course, it is preferable that such other detergent composition will also include a formula proportion of bentonite and little or no silicate and that in it zeolite will be a substantial proportion, preferably a major proportion of the builder present. Additionally, it should be of particle sizes substantially like that of the polyphosphate detergent composition of this invention and of a bulk density before mixing within 0.1 g./cc. of that of the detergent composition and of the final composition bulk density, which should be within the range of 0.2 to 0.9 g./cc., more usually from 0.5 or 0.6 to 0.8 g./cc. The manufacturing methods employed for making the base beads and the detergent compositions will be known to those of skill in the art from a reading of the present specification and the parent applications incorporated herein by reference. Also, such methods generally are described in U.S. Pat. Nos. 3,886,098 and 4,294,718. Accordingly, such processes need not be described in detail here. Suffice it to say that preferably the aqueous crutcher mix employed to produce a mixture for spray drying will normally be at a temperature in the range of 40° to 70° C. and the solids content of the crutcher mix will normally be from 50 to 65%. Spray drying may be effected in either a countercurrent or concurrent tower of normal design and after drying the product is screened to the desired size, e.g., No. 10 to 60 or 100, U.S. Sieve Series. The nonionic detergent is usually at elevated temperature, such as about 50° C. and after it is applied additional adjuvants, such as those which are heat sensitive, e.g., perfume, enzymes, may be sprayed onto or mixed in with the detergent.

The spray dried detergent, the spray dried base beads and the detergent compositions made from them include little or no silicate from the crutcher mix, although some silicate in solid form may be post-added. The post-added soluble powdered silicate, if employed, does not seem to react with the zeolite as much, so zeolite-silicate agglomerations that tend to deposit on laundered articles are reduced, compared to such deposits from products wherein the same proportion of silicate was added in the crutcher. Although, without the bentonite being present, silicate might often be used for its bead controlling and anti-corrosion effects, the crutcher mixes of present detergent composition components result in very acceptable beads being made by spray drying and such beads, when dissolved in wash water, have not been found to cause any corrosion of aluminum articles. Furthermore, the bentonite does not adversely affect the stability of the product and in fact, appears to help to hold the beads together, helping to make them resistant to crushing and powdering during shipment and use. The presence of the bentonite significantly improves the properties of the final detergent composition, resulting in higher calcium ion binding rates and in less zeolite being deposited on laundered fabrics. When the low molecular weight polyacrylate is present the base beads tend to become more porous and better absorb the nonionic detergent in liquid state, without unduly lowering the bulk density of the product. Considering that bentonite is a clay and serves as a binder, it might be expected to create deposition and gelation problems of its own. Therefore, the lowered deposition characteristics, absence of gelation, and ready product dispersion are surprising, and they are important results of the present invention.

The following examples illustrate but do not limit the invention. Unless otherwise indicated, all temperatures are in ° C. and all parts are by weight in the examples and throughout the specification. When any weights and proportions of zeolite are given, these are intended to be for the normal hydrate being used, because it is considered that the zeolite water of hydration does not leave the zeolite and does not become part of the aqueous solvent medium in the present crutching operations. Also, part of the water present in the base beads and the detergent compositions is present as water of hydration of the zeolite. Similarly, the moisture associated with the bentonite may also be considered not to be free moisture but because of the lesser percentage present this distinction can often be neglected, as a practical matter.

EXAMPLE 1

A crutcher mix for spray drying base beads according to this invention for subsequent conversion to a detergent composition by addition of synthetic nonionic organic detergent thereto is made at a solids content of about 55% in an aqueous medium by adding to the aqueous medium in the crutcher 22 parts of Linde hydrated zeolite 4A (20% water of crystallization), 0.1 part of sodium polyacrylate (Alcosperse 107D), 1.7 parts of fluorescent brightener (Tinopal 5BM, extra concentrated), 0.2 part of ultramarine blue powder, 24 parts of pentasodium tripolyphosphate, 10 parts of tetrasodium pyrophosphate, 8.3 parts of sodium carbonate and 10 parts of Mineral Colloid No. 101 (formerly THIXO-JEL No. 1, bentonite). During mixing of the various components the mixer speed, which at the start is low, is increased to medium and ultimately to high. After addition of all the constituents, which takes approximately fifteen minutes, mixing is continued for about an hour (in some cases as long as four hours of mixing may occur), during which time some of the water present, e.g., about two to six parts, may be lost by evaporation, and may be replenished, if desired. During the mixing time the crutcher slurry is continuously mobile and does not gel, set or cake. If desired, after all the components are in the crutcher and the mix is homogeneous the speed of the mixer may be slowed.

Starting about five minutes after all the components of the crutcher mix are present, the mix is dropped from the crutcher to a pump, which pumps it at a pressure of about 21 kg./sq. cm. into the top of a countercurrent spray tower wherein the initial temperature is about 430° C. and the final temperature is about 105° C. The base beads resulting are of a bulk density of about 0.4 g./cc. and a particle size range substantially between No. 10 and 60, U.S. Sieve Series (they are screened to such range, or they may be screened to another range, such as 10 to 100). The moisture content of the beads is in the range of 3 to 15% and almost always is in the range of 5 to 12%, normally being close to about 10%, e.g., 8 to 10%. The base beads are found to be satisfactorily free flowing, non-tacky and porous, yet sufficiently firm on the surfaces thereof to be commercially marketable. They are capable of absorbing significant proportions of liquid nonionic detergent without becoming objectionably tacky.

Detergent products are made from the spray dried beads by spraying onto the surfaces of such tumbling base beads a normally waxy nonionic detergent in liquid state. Neodol 23-6.5 is used but Neodol 23-7 or Neodol 25-7 (and sometimes Neodol 45-11) may be substituted. The nonionic detergent is in heated liquid state (at a temperature of about 45° to 55° C.). The quantity sprayed is such as to result in a final product containing about 15% of nonionic detergent. Proteolytic enzyme (Alcalase 1.7T or Maxazyme 375) is applied in powdered form to result in about a 1.5% concentration in the product, and perfume is sprayed onto the product to produce a 0.25% concentration therein. The resulting detergent compositions are of a bulk density of about 0.5 to 0.6 g./ml., with the increase in density being due to the absorption of the nonionic detergent.

The detergent made, of the above formula, is an excellent heavy duty laundry detergent and is especially useful for washing household laundry in automatic washing machines. It is physically and aesthetically advantageous and attractive because it is non-dusting and satisfactorily free flowing, which allows it to be packaged in narrownecked glass and plastic bottles, from which it flows readily for dispensing. The detergent compositions of the invention, containing bentonite, as described, are of improved calcium ion binding rates but more importantly, they leave less zeolite residue on laundry washed with them (in an automatic washing machine at usual concentrations for such products and at normal wash temperatures), especially when such laundry is line dried, than do similar compositions containing less or no bentonite and with sodium silicate in the spray dried base beads, as in the formulations of my "grandparent" patent application, Ser. No. 238,619. This difference is accentuated when the wash water is high in hardness, e.g., 200 p.p.m., as calcium carbonate, when the wash water is cold, and when a gentle agitation cycle is employed.

Following normal procedure, crutcher mixes will be made quickly and may be emptied quickly from the crutcher, sometimes being made within a period of as little as five minutes and being pumped out of the crutcher in as little as ten minutes. Yet, it is often important that the present mixes be able to withstand at least an hour in the crutcher without gelling or solidifying because sometimes holdups for such times are encountered in commercial production. The described crutcher mix is capable of being held for as long as four hours, and often appreciably longer, without gelling or solidifying, which is attributed, at least in part, to the presence of bentonite and the absence of silicate. This action of the bentonite is unexpected because bentonite also has a thickening effect on the crutcher mix, but although the mix may thicken appreciably it remains pumpable. Minor components of the crutcher mix, such as the fluorescent brightener and pigments, may be omitted therefrom and enzyme and perfume may be omitted from the final product, although it is highly preferable for all such materials to be present. The crutcher mix temperature may be modified, as by elevation to 52° C., and the proportions of the various components may be varied ±10%, ±20% and ±30%, while still maintaining them within the ranges previously given, and workable mixes that result in the desired beads and detergent compositions will be obtainable. The crutcher mix solids content may be varied over the range of 45 to 65%, preferably 50 to 65%, and good mixing and spray drying can result.

Other orders of addition of components to the crutcher may be employed but normally it will be desired to add silicate, if any is to be employed, last or near the end, and it is preferred that the bentonite also be added late in the process, preferably just before the silicate. Instead of using zeolite 4A, zeolites X and Y may be substituted, as may be other types of zeolite A. While it is preferred to employ the approximately 70% hydrated zeolite 4A (about 20% moisture content) of this example, various degrees of hydration of the zeolite are acceptable and in some instances nearly anhydrous crystalline zeolites or amorphous zeolites may be employed. Variations in the amount of bentonite within the range given, to 5%, 7%, 13% and 19% in the base bead, for example, still result in the making of useful products, but products containing the larger proportions of bentonite will ,generally be more effective in helping to prevent zeolite deposition on laundry. In some instances it may be desirable to utilize even higher percentages of bentonite, within the ranges set forth in this specification, taking care that the other components of the base bead will be such that the beads will be free flowing and effective detergents. The proportion of bentonite suitable to be employed commercially depends on a number of factors and usually will represent a balance struck between the desired diminution of zeolite residue and the desired building and other functional effects of other detergent composition components that could be incorporated in place of an increased amount of bentonite.

When the polyphosphate content is varied over the described range useful detergents result, with those of higher such contents being more effective detergents due to the excellent building effect of the polyphosphates. However, a balance of components is desirable to obtain the best physical properties of the product and sometimes therefore it may be better to utilize smaller proportions of polyphosphate, e.g., 20 to 40%, which are still very effective in detergency building action. When the proportion of nonionic detergent is modified, so as to be increased to over 20%, sometimes some difficulty may be obtained in having all the detergent absorbed into the interiors of the base beads of the present formula. By modifying the structure of the base beads, either by changing the proportion of polyacrylate utilized (increasing it) or by adding a small proportion of water soluble silicate in the crutcher, preferably following anti-gelling agents (a combination of citric acid and magnesium sulfate is preferred), the character of the base beads may be modified and their holding power for nonionic detergent may be increased, thereby improving flowability of the detergent composition beads. A similar improvement in flowability may be obtained by employing more zeolite and bentonite, both of which improve flowability of such types of particulate detergents.

The improvement noted in the detergent compositions of this invention depositing less residue on washed laundry may be verified by testing the described product against a control product of essentially the same formula, with no bentonite present and containing about 8% of sodium silicate in the final product. In such an evaluation a Whirlpool Suds Saver Model washing machine may be employed, with the washing periods being eight minutes at a gentle wash cycle. The detergent composition concentration should be about 0.06% and the wash water may be of mixed calcium and magnesium hardnesses, with a total of 200 p.p.m. hardness, as calcium carbonate. A test water temperature of 24° C. is used and the items washed are cotton, polyester, mixed acetate and nylon, and mixed polyester and cotton. After washing, the washed materials are observed wet and after line drying. Such testing will verify that moderate residue will be observed on all the control specimens but those washed with the invented detergent compositions will show appreciably less residue.

EXAMPLE 2

The experiment of Example 1 is repeated, without the polyacrylate being present in the crutcher mix. The throughput rate through the spray drying tower is diminished and the absorption capability of the base beads for nonionic detergent is also less. However, the crutcher mix does not freeze in the crutcher, the base beads can be manufactured by spray drying and the resulting detergent composition, although it is held lower in nonionic detergent content, e.g., about 15% nonionic detergent, is also a very useful product and is of satisfactory flow characteristics. Still, a minimum polyacrylate content (0.05 to 0.2%) is desirably present.

EXAMPLE 3

The procedure described in Example 1 is repeated, with 5% (final product basis) of sodium silicate of $Na_2O:SiO_2$ ratio of 1:2.4 being added to the crutcher as a 47.5% solids aqueous solution. The product made does not gel in the crutcher, following normal manufacturing procedures, but it is desirable to utilize magnesium sulfate and citric acid, as per my parent application Ser. No. 279,550 and the foregoing instructions, to prevent gelation or freezing when the holdup time may be appreciably longer than is normal. Also, the detergent composition made leaves more residue on washed laundry, which is especially noticeable, when the colors of such laundry are dark, the laundry is line dried, and the water soluble silicate is crutcher added.

EXAMPLE 4

The experiment of Example 1 is repeated with 5% of hydrous sodium silicate (Britesil) being post-added with the enzyme powder. Such post-added silicate does not adversely affect zeolite deposition on washed laundry as much as would be expected from a comparable proportion that is added to the crutcher, and in the present case the color lightening effect is not considered to be as objectionable. The post-added hydrous silicate does aid in corrosion prevention with respect to aluminum washing machine parts, and functions as a water softener and detergent builder.

EXAMPLE 5

By a process essentially like that of Example 1 base beads are made and from them is made a detergent product containing 30 parts of zeolite 4A, 30 parts of pentasodium tripolyphosphate, 20 parts of the nonionic detergent (Neodol 23-6.5 or 25-7), 5 parts of bentonite, 5 parts of water, 5 parts of sodium carbonate, 5 parts of sodium silicate ($Na_2O:SiO_2=1:2.4$), 1.7 parts of fluorescent brightener, 1.5 parts of magnesium sulfate, 1.3 parts of enzyme, 0.4 part of citric acid (as sodium citrate), 0.2 part of perfume, 0.2 part of ultramarine blue and 0.1 part of sodium polyacrylate. Such product is a useful heavy duty laundry detergent of good washing and flow characteristics but, while it deposits less zeolite-silicate aggregate on washed clothing than conventional zeolite- and silicate-containing detergents, its zeolite deposition characteristics are not as good as those of a comparable formula from which the silicate, magnesium sulfate and citric acid are omitted. Similar products result when the pentasodium tripolyphosphate is half or completely replaced with tetrasodium pyrophosphate.

EXAMPLE 6

Detergent compositions like those of Example 1 are made, utilizing 5 parts of tetrasodium pyrophosphate in place of 5 parts of the tripolyphosphate. The product resulting is as capable of absorbing nonionic detergent as the Example 1 product without any appreciable change in flow properties, and it is a good heavy duty detergent product, possibly somewhat superior to the Example 1 product in some cleaning aspects. Zeolite deposition prevention characteristics of this product are as good as those of the product of Example 1.

EXAMPLE 7

A conventionally spray dried detergent composition is made, containing about 15% of sodium linear tridecyl benzene sulfonate, 25% of zeolite 4A, 25% of pentasodium tripolyphosphate, 10% of tetrasodium pyrophosphate, 10% of bentonite, 5% of normal adjuvants and 10% of moisture, and such is blended with the composition of Example 1 in equal parts. Of course, the compositions are of approximately the same moisture contents (about 10%) and particle sizes, in the No. 10 to 100 (or 10 to 60) U.S. Sieve Series range and are of bulk densities before mixing within about 0.1 g./cc. of each other (about 0.5 g./cc. for this product and 0.5 to 0.6 g./cc. for that of Example 1 ). The combined product is of approximately the same flowability as that of Example 1 and is an excellent detergent, possessing the properties of both compositions, while being of reduced zeolite deposition characteristics, compared to a control containing the normal binding and corrosion preventing percentage of water soluble sodium silicate.

EXAMPLE 8

Following substantially the procedure described in Example 1 a crutcher mix is made from 36.9 parts of water, 1.2 parts of fluorescent brightener (Tinopal 5BM, extra concentrated) 0.1 part of ultramarine blue, 2.1 parts of magnesium sulfate (heptahydrate), 0.3 part of sodium citrate, 22.4 parts of zeolite 4A powder (partially hydrated, to about 20% moisture content), 23.0 parts of pentasodium tripolyphosphate, 7.4 parts of a 47.5% solids water solution of sodium silicate ($Na_2O$:$SiO_2$=1:2.4), 3.7 parts of sodium bentonite (formerly marketed as THIXO-JEL No. 2), and 2.8 parts of natural soda ash. The crutcher mix was spray dried in a manner like that previously described, with the moisture loss in drying being about 45.2%.

Onto 78.4 parts of the spray dried base beads, of particle sizes in the No. 10 to 100 range (screened), are sprayed 20 parts of Neodol 23-6.5, after which the beads are mixed with 1.3 parts of high activity proteolytic enzyme, and 0.3 part of detergent perfume is sprayed onto them. The final product has a zeolite content of 25%, a polyphosphate content (some TSPP is formed during crutching and spray drying) of 33%, a sodium bentonite content of 5% and a water soluble sodium silicate solids content of 5%. The moisture content is 5% and the active detersive ingredient (polyethoxylated higher fatty alcohol) content is 20%. The bulk density is about 0.7 g./cc. and the pH of its 1% solution is about 10.

The detergent composition made by this method is a satisfactory heavy duty nonionic detergent but does deposit somewhat more zeolite-silicate aggregate on washed clothing that is line dried than does a corresponding composition made without any water soluble silicate solids. It is preferred that in such corresponding composition there is also present about 0.1 to 0.5% of low molecular weight sodium polyacrylate, of the type previously described herein. Both products wash laundry well and are especially effective in cold water washing, due at least in part to the bentonite contents thereof and the almost instantaneous dispersion that is observed when the detergent is added to wash water (which dispersion also diminishes time for any reaction between soluble silicate and zeolite to form objectionable aggregates).

The invention has been described with respect to various examples and illustrations thereof but is not to be limited to these because it is clear that one of skill in the art, with the present description before him, will be able to utilize substitutes and equivalents without departing from it.

What is claimed is:

1. Free flowing, zeolite-containing spray dried base beads, of a bulk density in the range of 0.2 to 0.8 g./cc. and particle sizes in the range of No's. 10 to 100, U.S. Sieve Series, useful for the manufacture of a particulate built synthetic nonionic organic detergent composition, which composition is mechanically stable and of reduced zeolite deposition characteristics due to the presence therein of bentonite and the absence of water soluble silicate, comprising 15 to 35% of zeolite A, 5 to 20% of beneficiated Wyoming bentonite, having a swelling capacity, in water, of 3 to 15 ml./g., having a viscosity of 3 to 30 centipoises at 6% concentration in water, and containing at least 4% of moisture therein, 15 to 40% of pentasodium tripolyphosphate, 0.05 to 5% of sodium polyacrylate of a molecular weight in the range of about 1,000 to 5,000, 5 to 10% of moisture and 0% of sodium silicate, in which the proportion of bentonite:zeolite is in the range of 1:6 to 1:2, that of tripolyphosphate:zeolite is within the range of 1:2 to 2:1 and that of bentonite:tripolyphosphate is within the range of 1:6 to 1:2.

2. A detergent composition comprising one to ten parts of a first detergent composition comprised of free flowing, zeolite-containing spray dried beads, useful for the manufacture of a particulate built synthetic nonionic organic detergent composition, which composition is mechanically stable and of reduced zeolite deposition characteristics due to the presence therein of bentonite and the absence of water soluble silicate, which beads are by weight, 5 to 60% of water softening zeolite, 2 to 40% of bentonite, containing sufficient moisture to facilitate dispersion of the bentonite in wash water, 5 to 60% of polyphosphate, and 0% of water soluble silicate, which beads have absorbed in them 5 to 30% of nonionic detergent, mixed with ten parts to one part of a different, more readily flowable particulate detergent composition, which comprises 5 to 30% of a synthetic anionic organic detergent, 20 to 90% of builder for such detergent, 2 to 20% of adjuvant(s) and 3 to 15% of moisture, with both the mixed detergent compositions being of particulate sizes in the range of No's. 10 to 100, U.S. Sieve Series, and being of bulk densities, before mixing, within 0.1 g./cc. of each other and of the final composition bulk density, which is within the range of 0.5 to 0.8 g./cc.

* * * * *